US011814256B2

(12) United States Patent
Mandotti

(10) Patent No.: US 11,814,256 B2
(45) Date of Patent: Nov. 14, 2023

(54) FORMING ASSEMBLY OF MULTILAYER PACKETS OF WET WIPES

(71) Applicant: TEKNOWEB CONVERTING SRL, Palazzo Pignano (IT)

(72) Inventor: Pierangelo Mandotti, Palazzo Pignano (IT)

(73) Assignee: TEKNOWEB CONVERTING SRL, Palazzo Pignano (IT)

( * ) Notice: Subject to any disclaimer, the term of this patent is extended or adjusted under 35 U.S.C. 154(b) by 395 days.

(21) Appl. No.: 17/257,437

(22) PCT Filed: Jul. 2, 2019

(86) PCT No.: PCT/IT2019/050157
§ 371 (c)(1),
(2) Date: Dec. 31, 2020

(87) PCT Pub. No.: WO2020/008487
PCT Pub. Date: Jan. 9, 2020

(65) Prior Publication Data

US 2021/0221637 A1 Jul. 22, 2021

(30) Foreign Application Priority Data

Jul. 5, 2018 (IT) ..... 102018000006947

(51) Int. Cl.
*B65H 31/16* (2006.01)
*B65H 31/30* (2006.01)
*B65H 33/16* (2006.01)

(52) U.S. Cl.
CPC ..... *B65H 31/3081* (2013.01); *B65H 33/16* (2013.01); *B65H 31/3054* (2013.01); *B65H 2404/232* (2013.01); *B65H 2701/1924* (2013.01)

(58) Field of Classification Search
CPC ..... B65G 47/82; B65B 35/40; B65B 35/405; B65H 2404/311; B65H 5/16;
(Continued)

(56) References Cited

U.S. PATENT DOCUMENTS 3,718,267 A * 2/1973 Hiebert ..... B65G 57/03 198/817
3,866,905 A * 2/1975 Trogan ..... B65H 31/30 271/181

(Continued)

FOREIGN PATENT DOCUMENTS

EP 0 061 631 10/1982
GB 2 157 270 10/1985

OTHER PUBLICATIONS

International Search Report for PCT/IT2019/050157 dated Oct. 1, 2019, 3 pages.

(Continued)

*Primary Examiner* — Gregory W Adams
(74) *Attorney, Agent, or Firm* — NIXON & VANDERHYE

(57) ABSTRACT

A forming assembly of multilayer packets of wet wipes includes: a feeding device of wipes assemblies; a forming device of packets including wipes assemblies; a packet removing device, where the forming device receives the wipes assemblies from an upper level and releases the packets at a lower level; first and second bands closed in a loop, moving along a path having a respective operating section extending vertically, including blades facing one another along the respective operating section creating housings for single wipes assemblies and defining a free space; a moving index in the free space ejecting a predetermined number of wipes assemblies onto the removing device; and a movement member advancing the index through the free space, the index including a fixed body associated with the (Continued)

movement member and a moving portion associated with the fixed body, allowing the index height to vary with respect to the removing device.

19 Claims, 5 Drawing Sheets

(58) Field of Classification Search
CPC ..... B65H 31/3081; B65H 33/16; B65H 31/3054; B65H 2404/232; B65H 2701/1924
See application file for complete search history.

(56) References Cited

U.S. PATENT DOCUMENTS 3,993,188 A * 11/1976 Muller ..... B65H 31/3081 198/717
4,029,194 A * 6/1977 Feurstein ..... B65H 31/3081 198/456
4,902,184 A * 2/1990 Fritz ..... B65G 69/165 53/500
5,464,316 A * 11/1995 Kranz ..... B65H 29/40 414/798.2
5,584,477 A * 12/1996 Sakai ..... B41F 23/0443 271/240
5,724,785 A * 3/1998 Malanowski ..... B65B 21/24 53/259
6,106,219 A * 8/2000 Newsome ..... B65H 31/3081 414/790.6
8,978,870 B2 * 3/2015 Viatte ..... B65G 37/00 198/612
9,199,791 B2 * 12/2015 Pietsch ..... B65G 47/5127

OTHER PUBLICATIONS

Written Opinion of the ISA for PCT/IT2019/050157 dated Oct. 1, 2019, 6 pages.

* cited by examiner

FORMING ASSEMBLY OF MULTILAYER PACKETS OF WET WIPES

CROSS-REFERENCE TO RELATED APPLICATIONS

This application is the U.S. national phase of International Application No. PCT/IT2019/050157 filed Jul. 2, 2019 which designated the U.S. and claims priority to IT 102018000006947 filed Jul. 5, 2018, the entire contents of each of which are hereby incorporated by reference.

BACKGROUND OF THE INVENTION

Field of the Invention

The invention relates to the sector of lines for the production and packaging in multi-layer packets of disposable wipes, wet or not.

More in detail, the invention relates to a forming assembly of multilayer packets composed of a predetermined number of disposable wet wipes.

Description of the Related Art

According to prior art, lines for the production and packaging of disposable wipes in multilayer packets substantially comprise an initial unwinding zone of rolls of paper to form a multilayer web obtained from superimposing several strips of paper; an intermediate cutting zone of the web so as to produce groups of wipes folded on top of one another; a counting and ejection zone of the assemblies to form multilayer packets composed of a predetermined number of assemblies of wipes and a final packaging zone of said packets.

All the movement and synchronization operations are managed by specific sensors and electronic control boards of the electromechanical members.

The counting and ejection zone currently comprises forming assemblies of multilayer packets of wet wipes that use stacking devices of known type, adapted to count and superimpose the assemblies of wipes to form packets, generally comprising tamper means adapted to push the cut assemblies of wipes folded one on top of another downward, transferring them to a lowerator composed of a surface with parallel bars, spaced from one another, which is lowered supporting the packet being formed and, by retracting, transfers it from the guides of the main production line to secondary ejection and packaging lines, parallel to the main line, and optionally translated laterally with respect to it.

Conventionally, said tampers are of the type provided with an alternating vertically moving connecting rod and crank system, or with a vertical movement system controlled by a linear motor, or composed of a pneumatic cylinder with vertical rod. Alternatively, said tampers can carry out an eccentric movement, i.e. following assemblies of wipes, to increase the counting and ejection speed.

This system for obtaining counting, assembly and ejection of packets of wipes has some limits or drawbacks, particularly evident in production lines, which tend to be increasingly fast.

The alternating rectilinear movement carried out by the tampers, whether rectilinear or eccentric, unavoidably causes an inertia and a slowing of their path, above all during the motion reversal step and hence during ascent of the tamper.

Disadvantageously, synchronization and phasing of all the components of the machine is jeopardized, at times the assemblies of wipes fall onto the secondary line without being accompanied by the tamper and therefore in an irregular manner, compromising their correct stacking with other assemblies to form neat packets and causing undesirable halts in production and material waste.

Also the production speed is compromised by the alternating motion, as it is necessary to increase the distance between the assemblies of wipes and hence slow them down with respect to the maximum theoretical speed with which these assemblies are fed into the counting and ejection zone to give the tamper time to descend and ascend above the line on which the assemblies are placed. By way of example, the cutting zone operates with a speed of up to 2000 cuts/minute, while the counting and ejection zone is slowed down and operates at a maximum speed of 1000 packets/minute.

Even more disadvantageously, the tampers, descending and hitting the single assemblies from above, deform them creating a harmful "banana" effect, compromising the regularity of superimposing several assemblies on one another to form the packets, and also risking the formation of unsightly creases on the wipes in the contact points with the tamper.

Moreover, the higher the groups of wipes are, the greater the force that the tamper must impart to make them descend onto the secondary line, and the greater the deformation sustained by these groups is.

Although following tampers guarantee higher counting speed and fewer problems of deformation of the packets, they also introduce problems of synchronization of the components and correct verticality of the packets, above all when they are formed by several assemblies superimposed on one another.

Even more disadvantageously, there is a considerable waste of space both in width and length due to the use of counting and ejection devices arranged in series, which also translate into high costs both of the machine and of the structure to contain the machine.

SUMMARY OF THE INVENTION

The invention intends to overcome these limits, producing a forming assembly of multilayer packets composed of a predetermined number of disposable wet wipes which:

- is efficient, precise and speeds up production;
- does not deform and does not upset the assemblies of wipes during the step to pass from the main line to the secondary line;
- does not require a halt in production to replace components on the machine as a function of the height or of the format of the assemblies of wipes.

These objects are achieved with a forming assembly of multilayer packets of wet wipes as disclosed.

The invention presents numerous advantages:

- said first and said second band provided with blades carry out a circulatory movement, operating with a continuous vertical translation motion, without sudden reversals of direction and hence without inertia and decelerations;
- the continuous motion guarantees better synchronization between the feeding device of the assemblies of wipes and the removing device of the multilayer packets formed;
- production is accelerated, but at the same time precise and orderly;
- as there is no impact, the assemblies of wipes do not undergo deformation of any type during the passage from the upper main line of the feeding device to the lower secondary line of the removing device;

several assemblies can be associated with one another to form packets of different formats and due to the moving index that translates accompanying the packet being formed, greater control of the form of the stack obtained is guaranteed, without the risk of the wipes being upset and creating problems of overturning of the stack in the removing steps.

BRIEF DESCRIPTION OF THE DRAWINGS

The advantages of the invention will be more apparent below in the description of a preferred embodiment, provided by way of non-limiting example, and with the aid of the drawings wherein.

DESCRIPTION OF THE PREFERRED EMBODIMENTS

Figure 1:
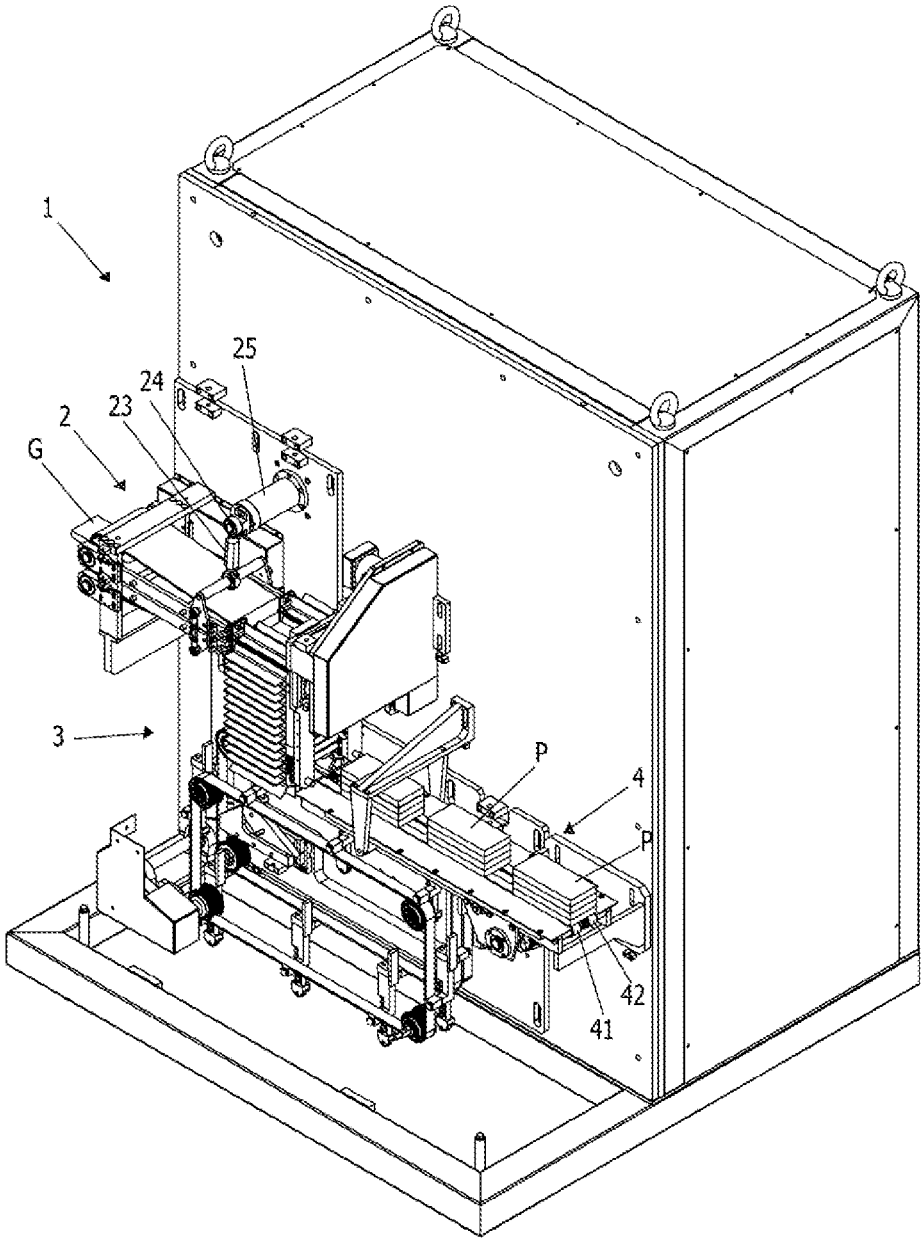
FIG. 1 represents, in a perspective view, a forming assembly of multilayer packets of wet wipes according to the invention.
Figure 2:
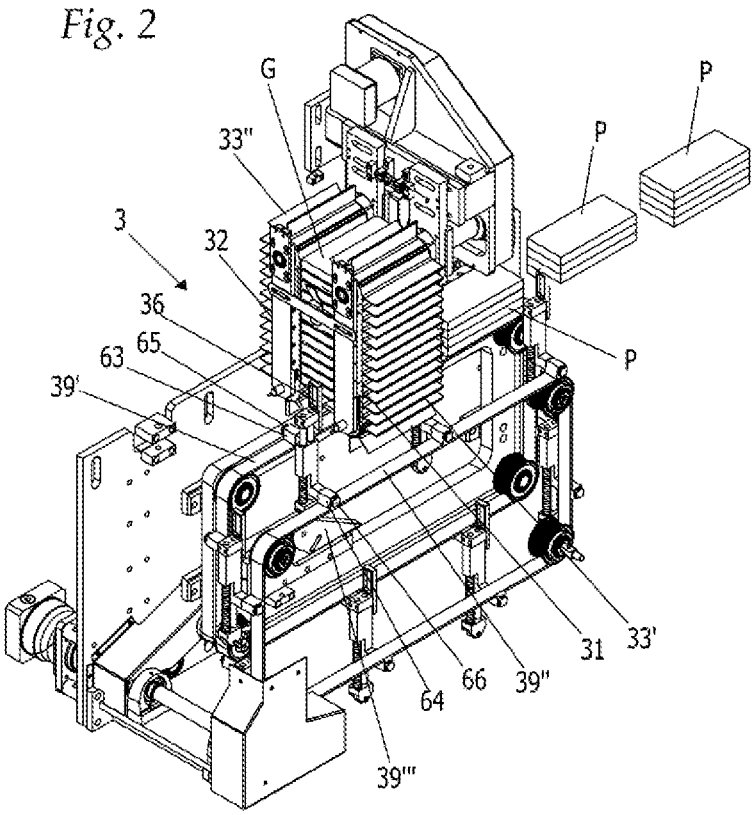
FIG. 2 represents, in a simplified perspective view, a forming device of the forming assembly according to the invention.
Figure 3:
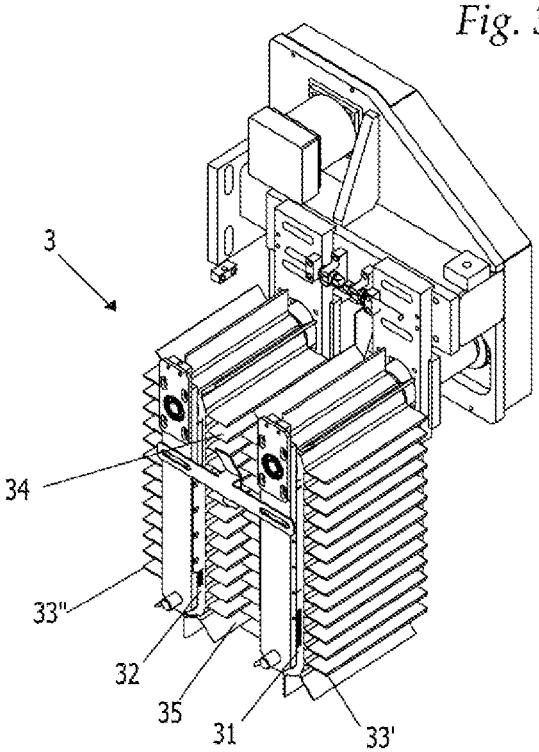
FIGS. 3, 4 and 5 represent, respectively in an axonometric, front and top view, partially sectioned along a horizontal plane, a first component of the forming device of the forming assembly according to the invention.

With reference to FIG. 1, there is shown a forming assembly 1 of multilayer packets P of wet wipes comprising:

a conveyor feeding device 2 of assemblies G of wipes coming from a cutting station (not illustrated);

a forming device 3 of multilayer packets P comprising a plurality of assemblies G of wipes;

a conveyor removing device 4 of said multilayer packets P toward a final packaging zone of said packets (not illustrated).

In particular, said forming device 3 is adapted to receive said assemblies G of wipes from an upper level in which said feeding device 2 is located and to translate them downward and release them at a lower level in which said removing device 4 is located, at the same time forming said multilayer packets P.

With reference to FIGS. 2-6, said forming device 3 is illustrated.

Said forming device 3 comprises a first band 31 and a second band 32 closed in a loop and movable along a circulatory type path that comprises a vertical operating stretch, arranged between the upper level of the feeding device 2 and the lower level of the removing device 4.

Said bands 31, 32 are maintained in position by pairs of toothed wheels 31', 31", 32', 32", of which at least one pair is motorized.

Said forming device 3 comprises first motor means 37 and corresponding drive means, preferably of the timing belt type 38, adapted to simultaneously move said first 31 and said second 32 band so that they are remain synchronized with each other but moving with opposite direction of rotation.

A single timing belt 38 that coacts with the pair of driving toothed wheels 31' and 32' of said first 31 and said second 32 band guarantees the coordination thereof.

Said first 31 and said second 32 band each comprise a plurality of blades 33', 33" applied at regular intervals and projecting orthogonally with respect thereto.

Figure 4:
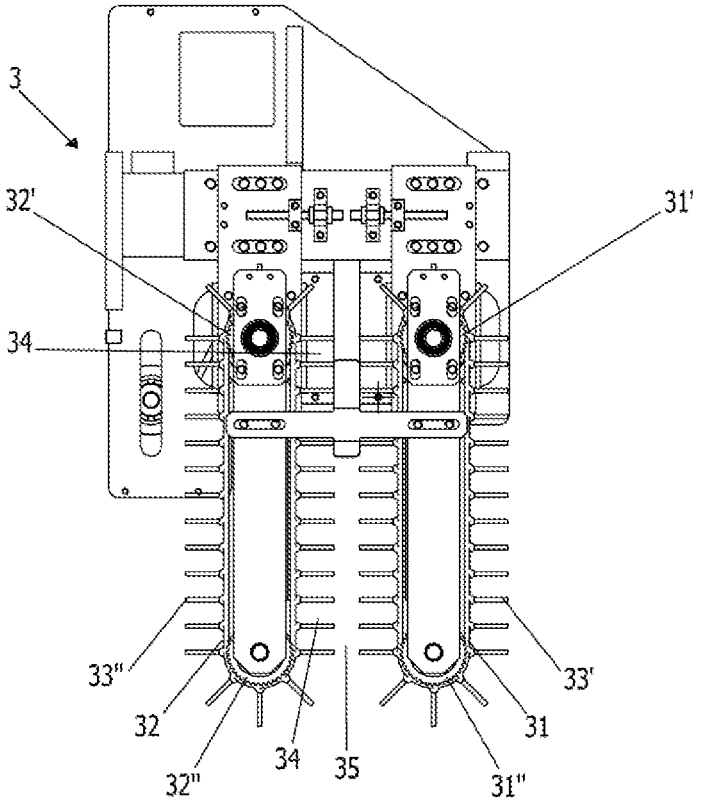
Figure 5:
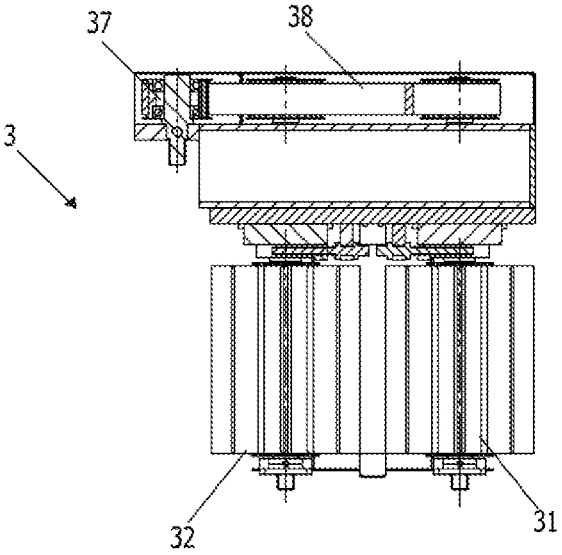

As is apparent from the front view of FIG. 4, the corresponding blades 33', 33" of said first band 31 and of said second band 32, in the vertical operating section, are facing each other so as to create housings 34.

Said housings 34 are adapted to accommodate single assemblies G of wipes coming from said feeding device 2 and to maintain them in position during the movement of said bands 31, 32 along their vertical descension operating path.

Advantageously, said first motor means 37 comprise a speed variation system (not illustrated) adapted to decelerate or accelerate the movement of said bands 31, 32 to allow or prevent positioning of an assembly G of wipes inside the available housing 34.

In order to be able to assemble multilayer packets P composed of a diversified number of assemblies G of wipes, it is necessary to be able to arrange in continuous sequence, in the specific housings 34, a given number of assemblies G of wipes, instead leaving one housing 34 empty as interval between one packet P being formed and the next. Said empty housing 34 is obtained by means of acceleration of said first motor means 37.

Said first 31 and said second 32 band are spaced from each other, so that the corresponding blades 33', 33" facing each other along the vertical operating section are separated to define a free space 35 between them.

Said forming device 3 further comprises at least one moving index 36, adapted to be inserted translating in said free space 35 to together eject a predetermined number of assemblies G of wipes from said housings 34 in order to form a multilayer packet P and to transfer it onto said removing device 4.

Figure 6:
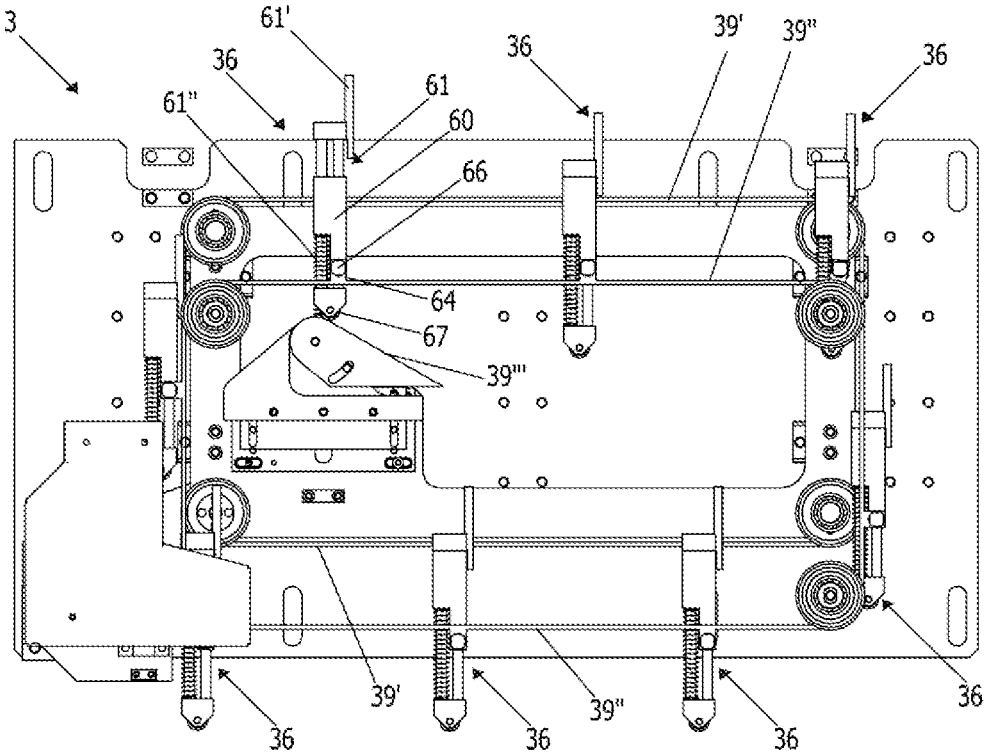
FIG. 6 represents, in a partially transparent front view, a second component of the forming device of the forming assembly according to the invention.

In the variant illustrated in FIG. 6, said forming device 3 comprises a plurality of moving indices 36.

Said forming device 3 comprises movement means for said plurality of indices 36 adapted to impart a horizontal translation movement thereon, in line with the extension of the conveyor removing device 4 of the multilayer packets P formed.

In particular, each moving index 36 accompanies the predetermined number of assemblies G of wipes that it has intercepted up to the removing device 4 and then it withdraws.

Each moving index 36 comprises a fixed body 60 and a moving portion 61 movingly associated with said fixed body 60 and this latter is in turn stably associated with said movement means.

An actuator member of known type is used to move the moving portion 61 with respect to the fixed body 60 of each index 36.

In the embodiment illustrated and preferred, said actuator member comprises cam means 39''', preferably with an adjustable profile.

Said cam means 39''' are configured to coact with the moving portion 61 of each index 36 and are arranged in the free space 35 where the predetermined number of assemblies G of wipes is ejected from the housings 34.

In the example illustrated, said movement means comprise a first 39' and a second 39" chain, preferably metal, closed in a loop, side by side with each other on two different levels, so as to be staggered in a vertical plane.

As an alternative to the chains, timing belts could be used.

Said first 39' and said second 39" chain comprise specific fixing means for said moving indices 36, which are distributed at a regular distance from one another.

Said fixing means allow said moving indices 36 to always remain in a predetermined ejection configuration, preferably in vertical position, along the whole of their closed path, even when they withdraw after having abandoned the multilayer packet P on the removing device 4.

Said fixing means comprise a first 63 and a second 64 housing stably associated respectively with said first 39' and said second 39" chain.

Figure 7:
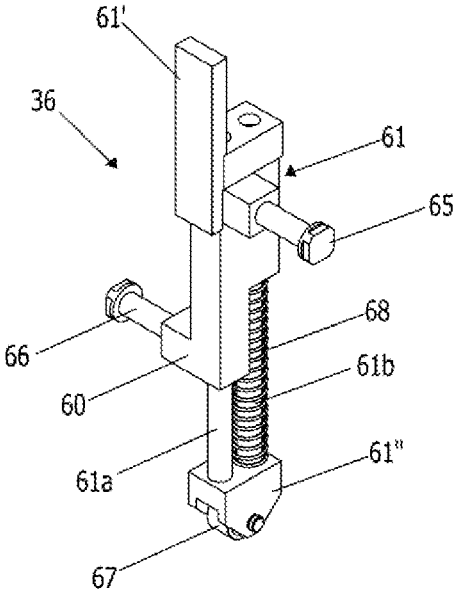
FIGS. 7 and 8 represent, respectively in an axonometric view and in a longitudinal section, a component of FIG. 6.
Figure 8:
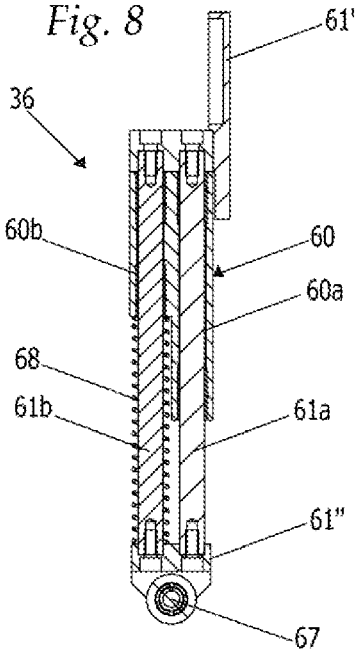

With particular reference to the detail of FIGS. 7 and 8, the fixed body 60 of each moving index 36 is associated with said first 39' and said second 39" chain.

For this purpose, said fixed body 60 comprises a first 65 and a second 66 pin, where said first 65 and said second 66 pin are adapted to coact in rotational relationship respectively with said first 63 and said second 64 housing obtained on said first 39' and said second 39" chain.

Said moving portion 61 comprises a head 61' and a tail 61".

Said head 61' is the projecting portion adapted to coact with said assemblies G of wipes, inserted in the free space 35 left between the blades 33', 33" of said first 31 and said second 32 band.

Said tail 61" is adapted to coact with said cam means 39'" to allow the movement of said moving portion 61 in said fixed body 60 so as to lift or lower said at least one moving index 36 with respect to the level of said removing device 4 as a function of the number, and hence of the thickness, of assemblies G of wipes that are required to compose the multilayer packet P.

In particular, said tail 61" comprises a wheel 67 adapted to read the profile of said cam means 39'" to determine said movement of said moving portion 61 in said fixed body 60.

Said tail 61" comprises a first 61*a* and a second 61*b* rod and said fixed body 60 comprises a first 60*a* and a second 60*b* seat, where said first 61*a* and said second 61*b* rod move in said first 60*a* and said second 60*b* seat against the elastic action of a return spring 68, in order to avoid the occurrence of unwanted torsional forces.

Figure 9:
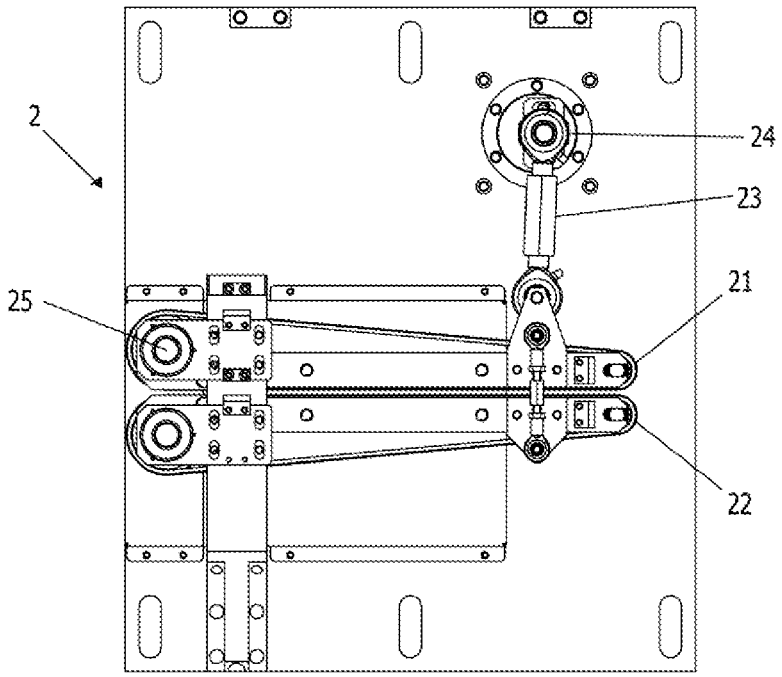
FIG. 9 represents, in a front view, the feeding device of the forming assembly according to the invention.

With particular reference to FIG. 9, said feeding device 2 comprises a first 21 and a second 22 conveyor, facing each other and superimposed, adapted to accompany said assemblies G of wipes to facilitate their insertion in the housings 34 of the forming device 3.

Said feeding device 2 also comprises an alternating movement mechanism for said first 21 and second 22 conveyor adapted to simultaneously move said conveyors 21, 22 in a manner coordinated with the vertical movement of said housings 34.

Said movement mechanism in substance imparts a swinging motion to the coupled ends of said first 21 and said second 22 conveyor.

Said swinging motion is in substance a cyclic movement of descent and ascent of the coupled ends of said first 21 and said second 22 conveyor, where the descent step takes place with the same speed at which said first 31 and said second 32 band move.

Said alternating movement mechanism comprises a connecting rod 23 and a crank 24.

Advantageously, said feeding device 2 comprises motor means 25 adapted to move said first 21 and second 22 conveyor synchronously controlled by a speed regulating system for managing the insertion of said assemblies G of wipes in said housings 34.

Said motor means 25 impart a variable speed to said first 21 and said second 22 conveyor, advantageously double with respect to the speed of the cutting step of the single assemblies G of wipes obtained from the multilayer web. Doubling of the speed allows the assemblies G of wipes to be spaced along the feeding device 2 to better manage their insertion in the housings 34 of the bands 31, 32.

Figure 10:
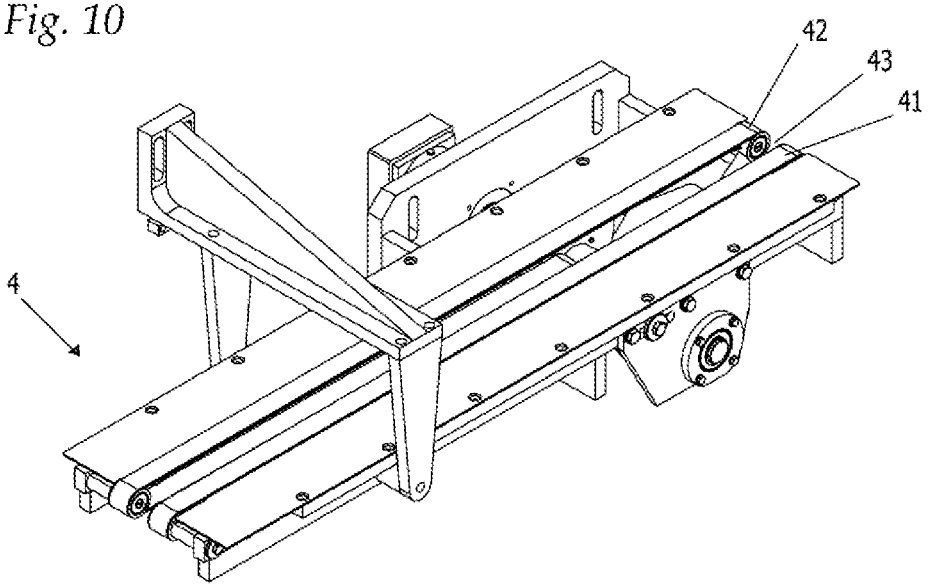
FIG. 10 represents, in an axonometric view, the removing device of the forming assembly according to the invention.

With particular reference to FIG. 10, said removing device 4 comprises a third 41 and a fourth 42 conveyor coplanar with each other.

Said third 41 and said fourth 42 conveyor have a linear extension and are spaced from each other to leave a free space 43 adapted to allow the passage of the moving indices 36 of the forming device 3.

Said first 31 and said second 32 band of the forming device 3, said first 39' and said second 39" chain of the movement means of the moving indices 36, said first 21 and said second 22 conveyor of the feeding device 2, and said third 41 and said fourth 42 conveyor of the removing device 4 are all toothed to guarantee the phasing and coordination of all the components without slippages.

Operation of the forming assembly 1 is as follows.

The multilayer web, obtained by superimposing various strips of paper, is sectioned by a cutting device so as to produce assemblies G of wipes folded one on top of the other that advance by means of said feeding device 2.

The swinging movement of the feeding device 2 accompanies the single assemblies G of wipes in the housings 34 obtained between the blades 33', 33" of said first 31 and said second 32 band.

The vertical movement of the bands 31, 32 causes the descent of the assemblies G of wipes, from the upper level of the feeding device 2 to the lower level in which the removing device 4 is located.

The moving index 36 passing cyclically into the free space 35 comprised between the facing blades 33', 33" intercepts and simultaneously pushes the single assemblies G of wipes so as to form a packet P.

The height of said moving index 36, or in any case of its projection beyond the lower level of the removing device 4, regulated by the cam means 39'", determines the height of the multilayer packet P of wipes formed by a specific number of assemblies G intercepted by the index.

The moving index 36, with the its horizontal translation movement, accompanies the multilayer packet P to the starting point of the conveyors 41, 42 of the removing device 4 and then withdraws, abandoning the packet P which can thus proceed toward a final packaging zone.

The invention claimed is:

1. A forming assembly of multilayer packets of wet wipes, the forming assembly comprising:

a conveyor feeding device of assemblies of wipes;

a forming device of multilayer packets comprising a plurality of assemblies of wipes;

a conveyor removing device of said multilayer packets, said forming device being configured to receive said assemblies of wipes from an upper level in which said feeding device is located and to release said multilayer packets at a lower level in which said conveyor removing device is located; and a first band and a second band closed in a loop, movable along a path having a respective operating section extending vertically, each of the first band and the second band comprising a plurality of blades arranged at regular intervals, projecting with respect to said first band and the second band, the corresponding blades of said first band and said second band face each other along the respective operating section to create housings configured to accommodate single assemblies of wipes coming from said feeding device and being spaced apart to define a free space between the blades, wherein said forming device comprises:

at least one moving index configured to be inserted in said free space to eject a predetermined number of assemblies of wipes from said housings in order to form a multilayer packet and to push said multilayer packet onto said conveyor removing device, the at least one moving index including a tail, and a movement member configured to advance said at least one moving index through said free space toward said conveyor removing device, and an adjustable cam configured to interact with the tail of the at least one moving index, said at least one moving index comprising a fixed body associated with said movement member and a moving portion movingly associated with said fixed body to allow the height of the at least one moving index to be varied with respect to said conveyor removing device, and the adjustable cam has an adjustable profile and is configured to coact with the moving portion of the at least one moving index such that the moving portion is lifted or lowered with respect to the conveyor removing device as a function of a thickness of the assemblies of wipes required to compose specific multilayer packets.

2. The forming assembly according to claim 1, wherein said forming device further comprises a first motor and corresponding drive configured to simultaneously move said first and said second bands so that the first and second bands remain synchronized with each other with an opposite direction of rotation.

3. The forming assembly according to claim 1, wherein said at least one movement member comprises a first chain and a second chain, placed side-by-side and staggered on two different levels in a vertical plane.

4. The forming assembly according to claim 3, wherein said fixed body is associated with said first chain and said second chain.

5. The forming assembly according to claim 3, wherein said first chain and said second chain comprise a fixing system configured to maintain said at least one index in a predetermined ejection configuration, when said at least one moving index is inserted in said free space to eject said predetermined number of assemblies of wipes.

6. The forming assembly according to claim 5, wherein said fixing system comprises a first housing and a second housing stably associated respectively with said first chain and said second chain, and said fixed body comprises a first pin and a second pin, said first pin and said second pin being configured to coact in rotational relationship respectively with said first housing and said second housing.

7. The forming assembly according to claim 1, further comprising an actuator configured to move said moving portion with respect to said fixed body of the at least one index.

8. The forming assembly according to claim 7, wherein said actuator comprises the cam.

9. The forming assembly according to claim 8, wherein said cam is disposed in said free space in which said predetermined number of assemblies of wipes is ejected from said housings.

10. The forming assembly according to claim 8, wherein said moving portion comprises a head configured to coact with said assemblies of wipes.

11. The forming assembly according to claim 10, wherein said tail comprises a wheel configured to coact with the adjustable profile of said cam.

12. The forming assembly according to claim 10, wherein said tail comprises a first rod and a second rod, said fixed body comprises a first seat and a second seat, said first rod and said second rod respectively moving in said first seat and said second seat against an elastic action of a return spring.

13. The forming assembly according to claim 3, wherein said at least one moving index comprises a plurality of moving indices associated with said first chain and said second chain at a regular distance.

14. The forming assembly according to claim 1, wherein said conveyor removing device comprises two coplanar conveyors, separated by another free space defined to allow passage of said at least one moving index.

15. The forming assembly according to claim 2, wherein said at least one movement member comprises a first chain and a second chain, placed side-by-side and staggered on two different levels in a vertical plane.

16. The forming assembly according to claim 4, wherein said first chain and said second chain comprise a fixing system configured to maintain said at least one index in a predetermined ejection configuration, when said at least one moving index is inserted in said free space to eject said predetermined number of assemblies of wipes.

17. The forming assembly according to claim 2, further comprising an actuator configured to move said moving portion with respect to said fixed body of the at least one index.

18. The forming assembly according to claim 3, further comprising an actuator configured to move said moving portion with respect to said fixed body of the at least one index.

19. The forming assembly according to claim 4, further comprising an actuator configured to move said moving portion with respect to said fixed body of the at least one index.

* * * * *